US008800662B2

(12) United States Patent
Miller

(10) Patent No.: US 8,800,662 B2
(45) Date of Patent: Aug. 12, 2014

(54) SUBSEA TEST TREE CONTROL SYSTEM

(75) Inventor: Darren Lee Miller, Perth (AU)

(73) Assignee: Vetco Gray Inc., Houston, TX (US)

( * ) Notice: Subject to any disclaimer, the term of this patent is extended or adjusted under 35 U.S.C. 154(b) by 221 days.

(21) Appl. No.: 13/224,517

(22) Filed: Sep. 2, 2011

(65) Prior Publication Data

US 2013/0056219 A1 Mar. 7, 2013

(51) Int. Cl.
*E21B 29/12* (2006.01)

(52) U.S. Cl.
USPC ..... 166/336; 166/344; 166/345; 166/368; 166/250.01

(58) Field of Classification Search
CPC ..... E21B 33/0355; E21B 34/045
USPC ..... 166/336, 337, 344, 345, 368, 357, 166/250.01; 251/129.01, 129.04
See application file for complete search history.

(56) References Cited

U.S. PATENT DOCUMENTS

| | | | | |
|---|---|---|---|---|
| 4,375,239 | A * | 3/1983 | Barrington et al. | 166/336 |
| 4,633,952 | A * | 1/1987 | Ringgenberg | 166/336 |
| 5,873,415 | A * | 2/1999 | Edwards | 166/344 |
| 6,015,013 | A * | 1/2000 | Edwards et al. | 166/360 |
| 6,343,654 | B1 | 2/2002 | Brammer | |
| 6,394,837 | B1 | 5/2002 | Edwards et al. | |
| 6,536,529 | B1 | 3/2003 | Kerr et al. | |
| 6,659,181 | B2 * | 12/2003 | Hartmann | 166/348 |
| 6,681,861 | B2 | 1/2004 | Davidson et al. | |
| 7,270,195 | B2 | 9/2007 | MacGregor et al. | |
| 7,513,308 | B2 | 4/2009 | Hosie et al. | |
| 2001/0054507 | A1 * | 12/2001 | Bartlett et al. | 166/368 |
| 2003/0141071 | A1 * | 7/2003 | Hosie | 166/350 |
| 2005/0217845 | A1 * | 10/2005 | McGuire | 166/100 |
| 2006/0042799 | A1 * | 3/2006 | Hosie et al. | 166/338 |
| 2009/0260829 | A1 * | 10/2009 | Mathis | 166/336 |

FOREIGN PATENT DOCUMENTS

| | | |
|---|---|---|
| GB | 2377131 | 12/2002 |
| GB | 2401617 | 11/2004 |
| WO | 0165063 | 9/2001 |
| WO | 02063341 | 8/2002 |

OTHER PUBLICATIONS

"Advances in Landing String Technology for Completion and Intervention Operations in Deep Water," D.J. More, 2003, OTC 15091.

(Continued)

*Primary Examiner* — James Sayre
(74) *Attorney, Agent, or Firm* — Bracewell & Giuliani LLP

(57) ABSTRACT

A subsea test tree control system provides operational control and power to subsea test tree equipment located within a subsea riser without an in riser umbilical to supply additional power to the subsea test tree control system. The subsea test tree control system includes a subsea horizontal subsea tree landed on a subsea wellhead, and a subsea control module communicatively coupled to the horizontal subsea tree. A subsea test tree stack is landed through the riser in the horizontal subsea tree. A subsea control module communication line extends through the horizontal subsea tree to terminate at a bore of the horizontal subsea tree proximate to the tubing hanger, and a riser string communication line communicatively couples to the subsea control module communication line to provide operational power and control the subsea test tree stack. Intervention workover control system umbilicals may bypass the subsea control module and directly connect to the subsea control module communication line.

25 Claims, 8 Drawing Sheets

(56) References Cited

OTHER PUBLICATIONS

"Intelligent Drill String Field Trials Demonstrate Technology Functionality" M.S. Reeves, et al 2004, SPE 92477.
"An Innovative Workover Riser System for 3000m Water Depth," J.R.F. Moreira, et al., 2003, OTC 15183.
"Design of Well Completion and Intervention Systems for Deployment from Dynamically Positioned Vessels," D. Harrold, 2003, OTC 15085.
"SenTURIAN Electrohydraulic Operating System, Well Control for Testing and Completion", www.slb.com/services/characterization/testing/subsea_landin_string/sentree_landing_string_systems/in_riser_control_systems/senturian.aspx, last visited Jul. 6, 2011.

* cited by examiner

SUBSEA TEST TREE CONTROL SYSTEM

BACKGROUND OF THE INVENTION

1. Field of the Invention

This invention relates in general to subsea completions, interventions, and workovers and, in particular, to a system and method for an umbilical-less subsea test tree control system.

2. Brief Description of Related Art

In some interventions, completions, and workovers, a horizontal christmas tree is used as part of the completion. The horizontal christmas tree includes a subsea control module that supplies hydraulic or electric power to operations below the mudline. During completion and workover operations, a riser will extend from the horizontal tree to a rig or ship at the surface. An intervention or workover stack, including a tubing hanger, universal running tool, and subsea test tree, will often be run down the riser to interact with the horizontal tree. Hydraulic and/or electrical umbilicals are run within the riser to provide hydraulic and/or electric power to the intervention or workover stack. A riser control module may be run with the intervention or workover stack to the horizontal tree level to control operation of the intervention or workover stack. The riser control module requires separate system control equipment at the surface that is connected to the riser control module through the hydraulic and electric umbilicals.

As the water depth increases, direct hydraulic control during the running of tubing and well workover is no longer practical due to the unacceptable hydraulic response times. As a result most all deepwater control systems employ electro hydraulic multiplex (EH MUX) equipment where hydraulic energy is stored in accumulators close to the user, usually with the riser control module, and actuated by electrical signal from the surface. As an alternate to a multiplex solution, a direct electric signal can also be sent directly to each function. Such systems have been developed and are currently in use on deepwater wells around the world. Hydraulic umbilicals will still be run within the riser to maintain hydraulic pressure within the accumulators.

Progressively, in deeper water, an umbilical that is strapped to the landing string, feeds the hydraulic accumulators, and transmits control signals and electricity to the control pod is becoming a capital and operating expenditure cost driver. The deeper the water, the longer the umbilical, which not only drives the umbilical cost, but also adds cost to storage reels and rigging equipment needed at the surface to support the umbilical. Furthermore, the increased overall umbilical weight and size will also impact the capacity of the drill rig. This is the case for both open-water and in-riser systems.

Operationally, strapping the umbilical to the landing string during running and retrieval is a time consuming task. From a safety perspective, manually fastening the umbilical to the riser string using riser clamps is also undesirable because it requires increased worker interaction with equipment around the well opening. In addition, increasing water depths increase the risk of snagging and damage to the umbilical during running and retrieval. This also increases the operational risk of losing items downhole.

An emerging option for deepwater well completion is using a surface blow out preventer (SBOP) on a dynamically positioned drill rig. Combined with a reduced diameter marine riser, from 21" to 16" or even 14", as well as the elimination of choke and kill lines, the depth rating of existing rigs can be increased and capital saved. Wells have already been successfully drilled using a SBOP in this way. In such a development, an extreme premium is placed on real estate inside the smaller marine riser. This available space is further reduced by the need for a landing string to support the intervention or workover stack at the horizontal subsea tree. This further reduces the space for umbilicals. In addition, an SHOP will require a slick joint in the landing riser at the rig SBOP location. This means that the umbilical will need to be terminated at the slick joint or somehow sealed within the slick joint in order to ensure a pressure containing seal around the riser. This further complicates the intervention or workover operations, increasing costs and risks to worker safety. Therefore a subsea test tree control system for use in interventions, workovers, and completions that may be used without hydraulic and/or electrical umbilicals in the riser is desirable.

SUMMARY OF THE INVENTION

These and other problems are generally solved or circumvented, and technical advantages are generally achieved, by preferred embodiments of the present invention that provide an umbilicalless subsea test tree control system.

In accordance with an embodiment of the present invention, a method for controlling a subsea completion or workover assembly in a subsea well having a horizontal subsea tree with a bore landing shoulder for receiving a tubing hanger is disclosed. The method provides the horizontal tree with a passage leading from an exterior of the tree to the landing shoulder, and then connects a riser from the horizontal tree to a platform at a sea surface. The method provides the tubing hanger with a landing surface and a port leading from the landing surface, and secures the tubing hanger to a running tool while connecting the port to the running tool. The method then runs the tubing hanger and the running tool thru the riser to land on the landing surface of the landing shoulder and register the port with the passage. Hydraulic fluid pressure and electric potential are supplied to the running tool to cause the running tool to set the tubing hanger in the tree; wherein at least one of the hydraulic fluid pressure or the electrical potential pass through the passage in the tree and the port to the running tool. Subsea completion or workover operations are then performed with at least one of the hydraulic fluid pressure and the electrical potential provided through the passage. The method may provide for direct power and control of the subsea test tree functions through hydraulic pressure or electric potential supplied through passages in the tubing hanger that register with passages in the horizontal tree.

In accordance with another embodiment of the present invention, a method for controlling a subsea completion or workover assembly in a subsea well having a horizontal subsea tree with a bore landing shoulder for receiving a tubing hanger is disclosed. The method provides the horizontal tree with a passage leading from an exterior of the tree to the landing shoulder and a subsea control module (SCM) that provides hydraulic fluid pressure to the passage to control valves of the horizontal tree. The method then connects a riser from the horizontal tree to a platform at a sea surface, and provides the tubing hanger with a landing surface and a port leading from the landing surface. The method secures the tubing hanger to a running tool and connects the port to the running tool. Next, the method runs the tubing hanger and the running tool thru the riser to land on the landing surface of the landing shoulder, registering the port with the passage. The method then supplies hydraulic fluid pressure to the running tool to cause the running tool to set the tubing hangers in the tree; wherein the hydraulic fluid pressure passes through the passage in the tree and the port to the running tool. Subsea completion or workover operations are then performed with the hydraulic fluid pressure provided through the passage. The method may provide for direct power and control of the subsea test tree functions through hydraulic pressure or electric potential supplied through passages in the tubing hanger that register with passages in the horizontal tree that are in turn supplied by the subsea control module.

In accordance with yet another embodiment of the present invention, a subsea completion or workover assembly in a subsea well having a horizontal subsea tree with a bore landing shoulder for receiving a tubing hanger is disclosed. The assembly includes a passage formed in the horizontal tree leading from an exterior of the tree to the landing shoulder, and a riser extending from the horizontal tree to a platform at a sea surface. The tubing hanger has a landing surface and a port leading from the landing surface. The tubing hanger secures to a running tool and connects the port to the running tool. The tubing hanger and the running tool land on the landing surface of the landing shoulder, registering the port with the passage. The hydraulic fluid pressure and electric potential are supplied to the running tool to cause the running tool to set the tubing hanger in the tree; wherein at least one of the hydraulic fluid pressure or the electrical potential pass through the passage in the tree and the port to the running tool to perform subsea completion or workover operations with at least one of the hydraulic and electrical potential provided through the passage. The apparatus may provide for direct power and control of the subsea test tree functions through hydraulic pressure or electric potential supplied through passages in the tubing hanger that register with passages in the horizontal tree.

An advantage of a preferred embodiment is that it provides a subsea test tree control system (STTCS) that eliminates the need for umbilicals to be run within the riser string. This STTCS reduces running and retrieval time, allowing intervention, workover, and completion operations to be performed in a shorter time period. In addition, the shorter running and retrieval time significantly reduces the operating costs associated with intervention, workover, and completion activities. Still further, the disclosed STTCS reduces the amount of equipment needed for the intervention, workover, and completion activities, further reducing the cost of use. In addition, the elimination of expensive umbilical reel assemblies further reduces the operational risk to workers during running and retrieval operations, greatly increasing worker safety.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning rig operation, initial well completion, and the like have been omitted inasmuch as such details are not considered necessary to obtain a complete understanding of the present invention, and are considered to be within the skills of persons skilled in the relevant art.

Figure 1:
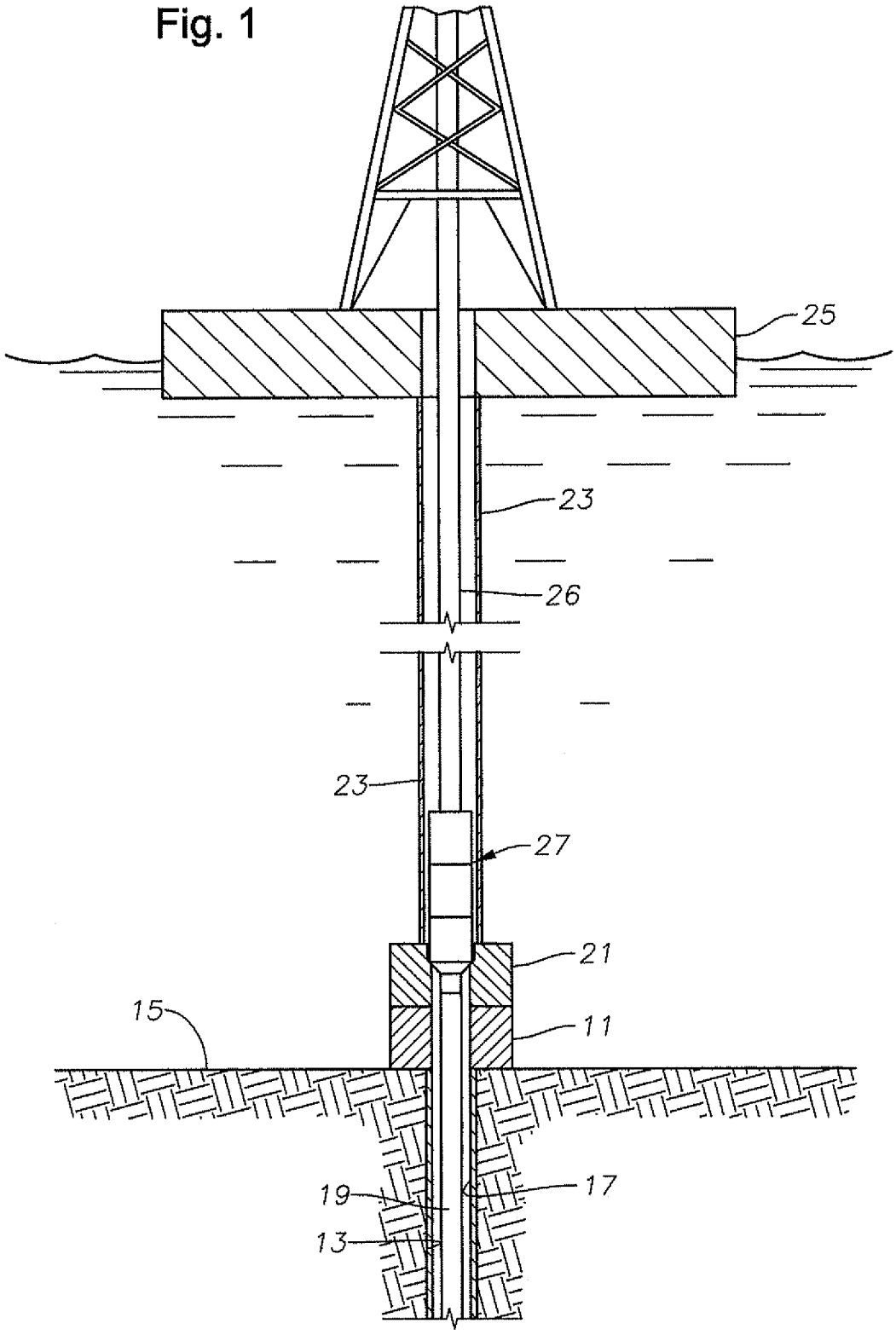
FIG. 1 is a schematic representation of a subsea test tree control system (STTCS) disposed at a subsea wellhead in accordance with the disclosed embodiments.

Referring to FIG. 1, a subsea wellhead 11 is disposed within a wellbore 13 located at a sea floor location 15. The wellbore 13 may be lined or cased with a casing string 17 extending from the wellhead to a location subsurface. In addition, a tubing string 19 may be suspended within the wellbore for production of hydrocarbons from wellbore 13. In the illustrated embodiment, a horizontal subsea tree 21 is landed on wellhead 11. A subsea riser 23 extends from the horizontal subsea tree 21 to a platform 25 located on a sea surface. Platform 25 may be a floating rig, a workover vessel, or the like. A landing string 26 may extend from the platform to horizontal subsea tree 21 and support an subsea test tree control system (STTCS) 27 at horizontal tree 21. A person skilled in the art will understand that horizontal subsea tree 21 includes production ports (not shown) and valves (not shown) that connect to subsea flowlines to allow flow of well fluid to additional production apparatuses located on the sea floor. A person skilled in the art will understand that the schematic representation of FIG. 1 may comprise a workover, a well intervention, a well recompletion, or the like.

Figure 2:
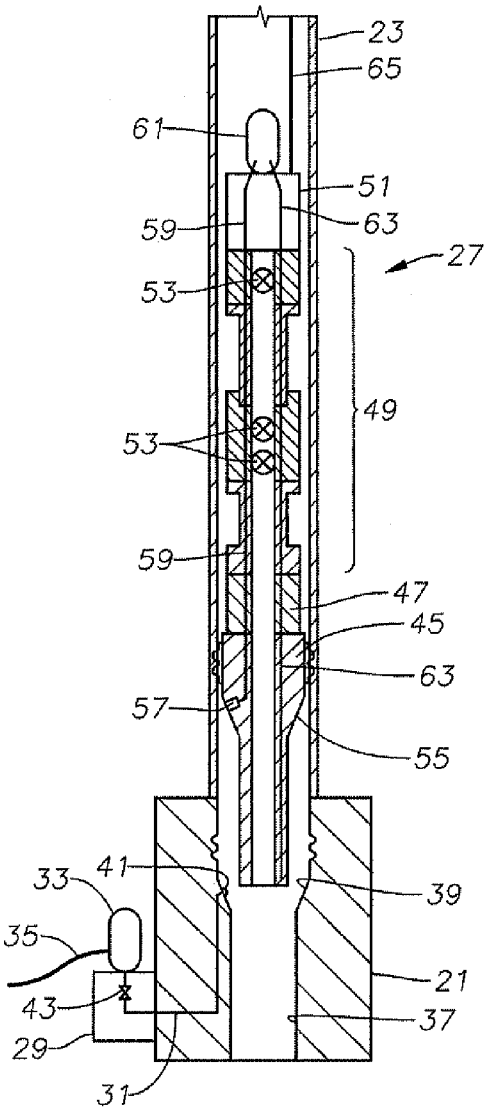
FIG. 2 is a schematic representation of a portion of the STTCS of FIG. 1, prior to landing at a horizontal subsea tree.

Referring to FIG. 2, STTCS 27 is shown in more detailed disposed within riser 23 prior to landing in horizontal subsea tree 21. In the illustrated embodiment, a subsea control module (SCM) 29 communicatively couples to horizontal subsea tree 21. SCM 29 feeds a subsea control module communication line (SCM communication line) 31 formed within horizontal subsea tree 21. In the embodiment of FIG. 2, SCM 29 includes a subsea control module accumulator (SCM accumulator) 33. SCM accumulator 33 supplies hydraulic pressure to SCM communication line 31. SCM accumulator 33 is, in turn, supplied with hydraulic pressure from a SCM hydraulic umbilical 35 extending to a manifold, production facility, or the like. A person skilled in the art will understand that horizontal subsea tree 21, SCM 29, and SCM hydraulic umbilical 35 may be placed on wellhead 11 with the original well completion. SCM hydraulic umbilical 35 may control valves on horizontal subsea tree 21 during normal operations other than a workover. SCM hydraulic umbilical 35 may be permanently installed.

SCM communication line 31 extends from SCM 29 through horizontal subsea tree 21 to a bore 37 formed in horizontal subsea tree 21. In the illustrated embodiment, bore 37 defines an upwardly facing conical landing shoulder 39. Bore 37 has a first diameter from an upper end of horizontal subsea tree 21 to conical landing shoulder 39, and a second diameter from conical landing shoulder 39 to a junction with subsea wellhead 11 (not shown in FIG. 2). As shown, the first diameter is larger than the second diameter, wherein conical landing shoulder 39 has a slope between the first diameter and the second diameter. SCM communication line 31 terminates on conical landing shoulder 39 in a spherical face 41. An actuable valve 43 will be positioned on SCM communication line 31 to control hydraulic pressure flowing through SCM communication line 31. In the illustrated embodiment, valve 43 may be controlled from the surface.

As shown in FIG. 2, STTCS 27 includes a tubing hanger (TH) 45, a tubing hanger running tool (THRT) 47, a subsea test tree (STT) 49, and a riser control module (RCM) 51. TH 45 comprises a tubing hanger adapted to support production tubing 19 (not shown in FIG. 2) suspended within horizontal subsea tree 21 and subsea wellhead 11. THRT 47 couples to TH 45 above TH 45 and is adapted to set TH 45 in horizontal subsea tree 21. STT 49 couples to THRT 47 above THRT 47 and is adapted to perform operational tasks associated with intervention, workover, and recompletion activities. A person skilled in the art will understand that STT 49 may be any suitable landing string function. STT 49 may include one or more valves 53 adapted to operate functions within STTCS 27. RCM 51 couples to STT 49 above STT 49 and controls the operation of and supplies hydraulic pressure to THRT 47, and STT 49.

In the illustrated embodiment, TH 45 includes a downwardly facing conical surface 55. TH 45 has a first diameter extending upward from conical surface 55, and a second diameter extending downward from conical surface 55. As shown, conical surface 55 has a slope from the first diameter to the second diameter that is approximately equivalent with the slope of conical surface 39. A spheri-seal 57 is positioned on conical surface 55 and communicatively couples with an STTCS communication line 59. STTCS communication line 59 extends through the tubular wall of STTCS 27 from conical surface 55 through TH 45, THRT 47, STT 49, and RCM 51. In the illustrated embodiment, STTCS communication line 59 communicatively couples to an RCM accumulator 61 mounted to RCM 51. As shown, RCM accumulator 61 comprises a storage vessel for hydraulic pressure. An operational communication line 63 extends through the tubular wall of STTCS 27 from RCM 51 to STT 49, THRT 47, and TH 45. Operational communication line 63 is supplied with hydraulic pressure from RCM accumulator 61. Operational communication line 63 communicatively couples with operational functions, such as valves 53 of STT 49, THRT 47, and TH 45 to supply hydraulic pressure to STT 49, THRT 47, and TH 45 in response to control inputs from RCM 51. In the illustrated embodiment, an electrical umbilical 65 extends from RCM 51 to surface platform 25. Electrical umbilical 65 provides control communication between RCM 51 and operators located on platform 25. Operators may send control signals to RCM 51 through electrical umbilical 65 and, in turn, RCM 51 will receive the signals and operate appropriate valves to provide hydraulic pressure to the appropriate device, STT 49, THRT 47, or TH 45, to perform a function in response to the control signals. Electrical umbilical 65 may be installed only during workover operations, then removed following completion of workover operations.

Figure 3:
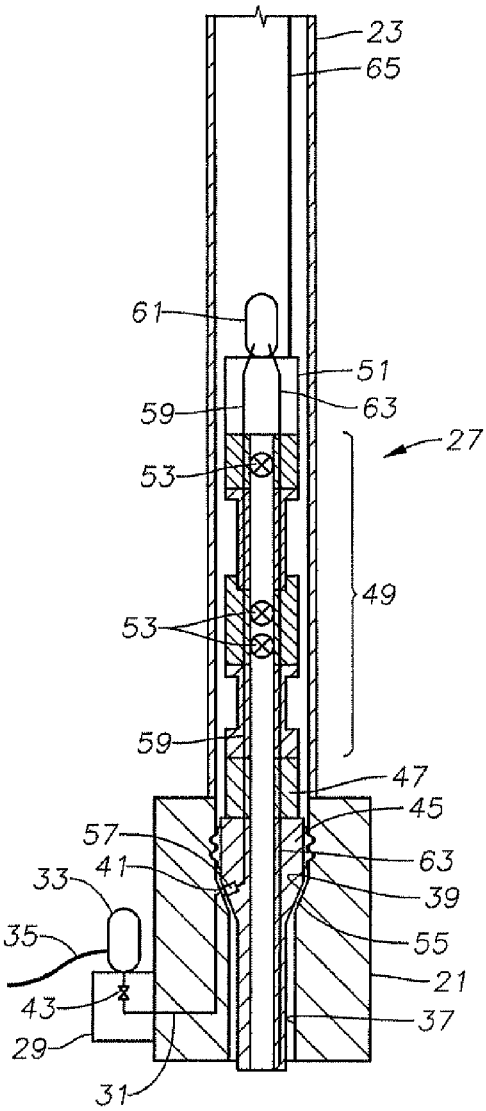
FIG. 3 is a schematic representation of the portion of the STTCS of FIG. 2, following landing at the horizontal subsea tree.

Referring now to FIG. 3, STTCS 27 will be lowered through riser 23 until conical shoulder 55 of TH 45 lands on conical shoulder 39 of horizontal subsea tree 21. As shown, spheri-seal 57 will be aligned with spherical face 41. When conical shoulder 55 lands on conical shoulder 39, spherical face 41 will insert into spheri-seal 57, and spheri-seal 57 will seal to spherical face 41. Hydraulic fluid may then flow from SCM communication line 31 to STTCS communication line 59. In this manner, spherical face 41 and spheri-seal 57 provide a communication connection between SCM communication line 31, and STTCS communication line 59. Valve 43 may then be opened in response to a signal from the surface so that SCM 29 may supply hydraulic pressure to SCM communication line 31. Hydraulic pressure will then flow into STTCS communication line 59 through spherical face 41 and spheri-seal 57. This hydraulic pressure will trickle charge RCM accumulator 61, maintaining hydraulic pressure within STTCS 27 without the need of a hydraulic umbilical extending from platform 25 to RCM 51 within riser 23.

Figure 4A:
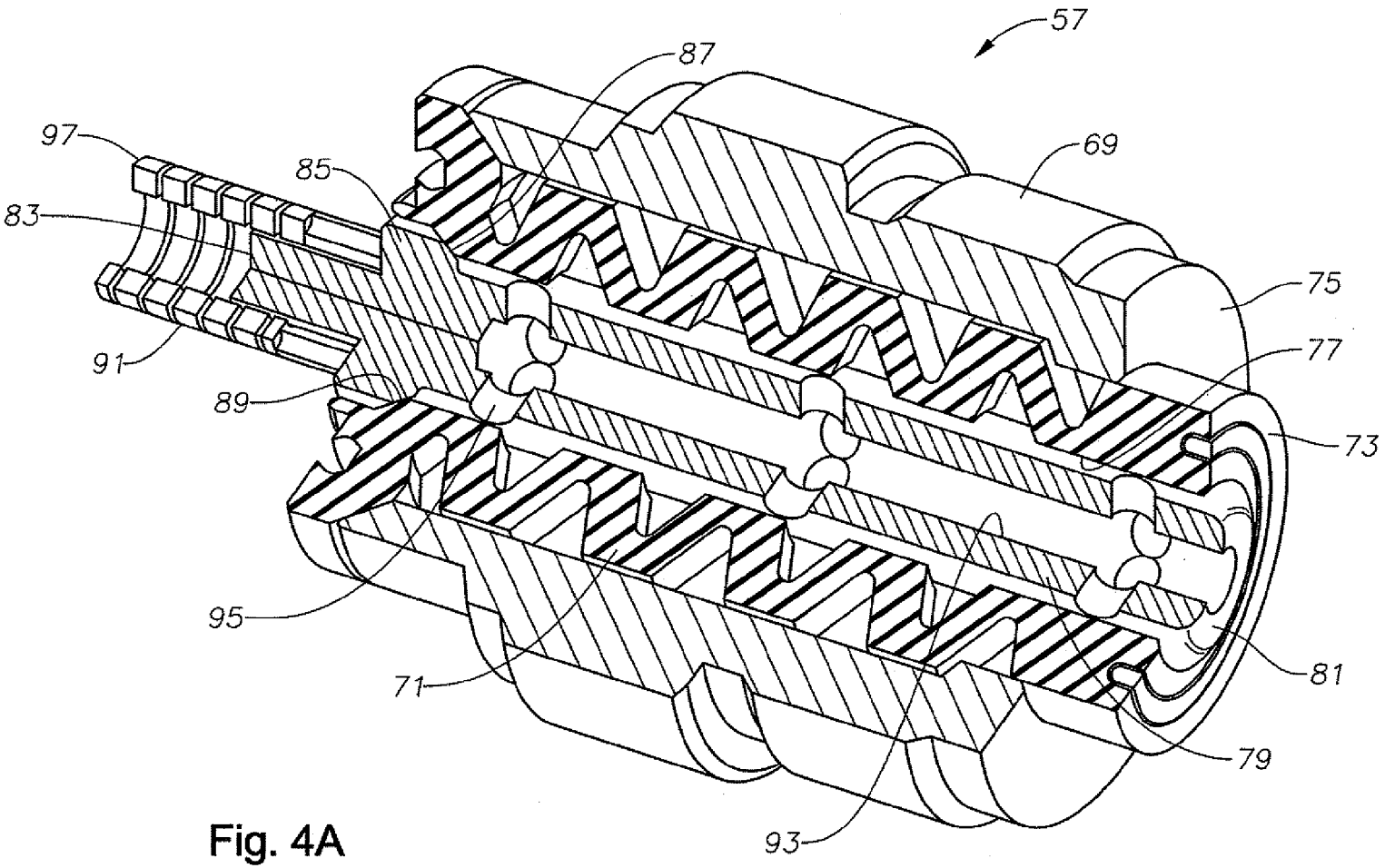
FIG. 4A is a partial cut-away view of a spheri-seal in accordance with the disclosed embodiments.
Figure 4B:
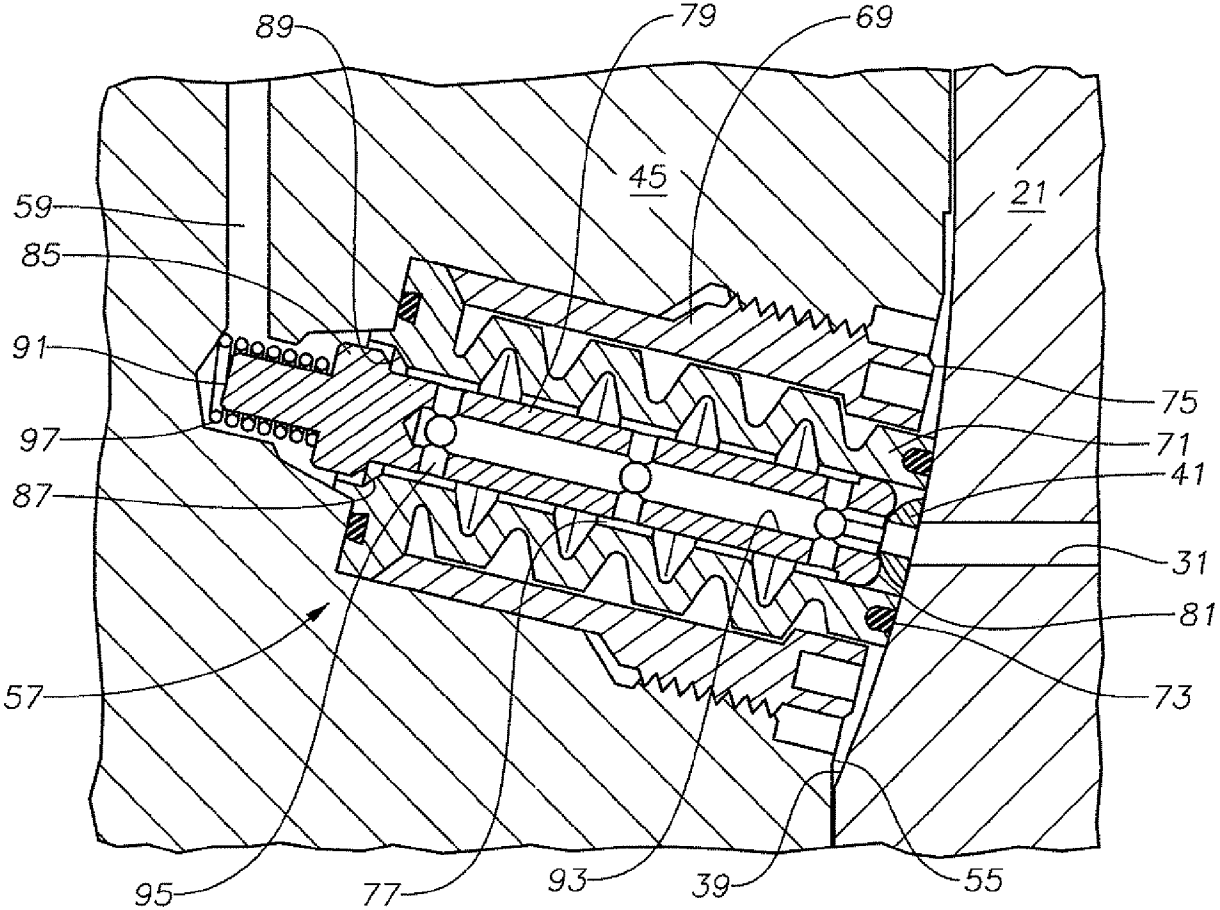
FIG. 4B is a sectional view of the spheri-seal of FIG. 4A in an open position.

Referring to FIG. 4A, there is shown a partial cut-away view of a spheri-seal 57. As shown, spheri-seal 57 has a tubular body 69. A seal assembly 71 is positioned within tubular body 69 and has a first end 73 protruding from a first end 75 of tubular body 69. Seal assembly 71 includes a tubular passage 77 into which a stem 79 is inserted. In the illustrated embodiment, stem 79 has an outer diameter that is substantially equivalent with the inner diameter of tubular passage 77 so that fluid may not flow between the inner diameter of tubular passage 77 and stem 79 when stem 79 is fully inserted into tubular passage 77. Stem 79 has a first end 81 and a second end 83. In the illustrated embodiment, first end 81 is proximate to first end 73 of seal assembly 71. An annular protrusion 85 is formed on stem 79 proximate to second end 83. An annular shoulder 87 of annular protrusion 85 faces toward first end 81 and may seal to a corresponding shoulder 89 of seal assembly 71 when stem 79 is fully inserted into tubular passage 77 of seal assembly 71. Seal assembly 71 includes a second end 91 defining a coupling for a fluid communication line, such as STTCS communication line 59 of FIG. 2 and FIG. 3. Stem 79 includes a fluid passage 93 formed in a center of stem 79. Fluid passage 93 extends from first end 81 to annular protrusion 85. Stem 79 includes a flow passage 95 that, in the illustrated embodiment, intersects fluid passage 93 perpendicular to fluid passage 93. Flow passage 95 is formed proximate to annular protrusion 85. When stem 79 is not inserted fully into tubular passage 77, as shown in FIG. 4B, fluid may flow through fluid passage 93, into flow passage 95, and then into STTCS communication line 59 of FIGS. 2-3. A spring 97 is positioned on second end 83 of stem 79. Spring 97 will interact with a tubular wall of TH 45 to bias stem 79 to the position illustrated in FIG. 4A.

Referring to FIG. 4B, when conical shoulder 55 of TH 45 lands on conical shoulder 39 of horizontal subsea tree 21, as shown in FIG. 3, spherical face 41 will interact with first end 81 of stem 79 of spheri-seal 57. Spherical face 41 will move stem 79 so that annular shoulder 87 of annular protrusion 85 no longer sealingly contacts annular shoulder 89 of seal assembly 71. Fluid may then flow from SCM communication line 31, through spherical face 41, into fluid passage 93 of stem 79, through flow passage 95, around annular protrusion 85, and into STTCS communication line 59.

Figure 5:
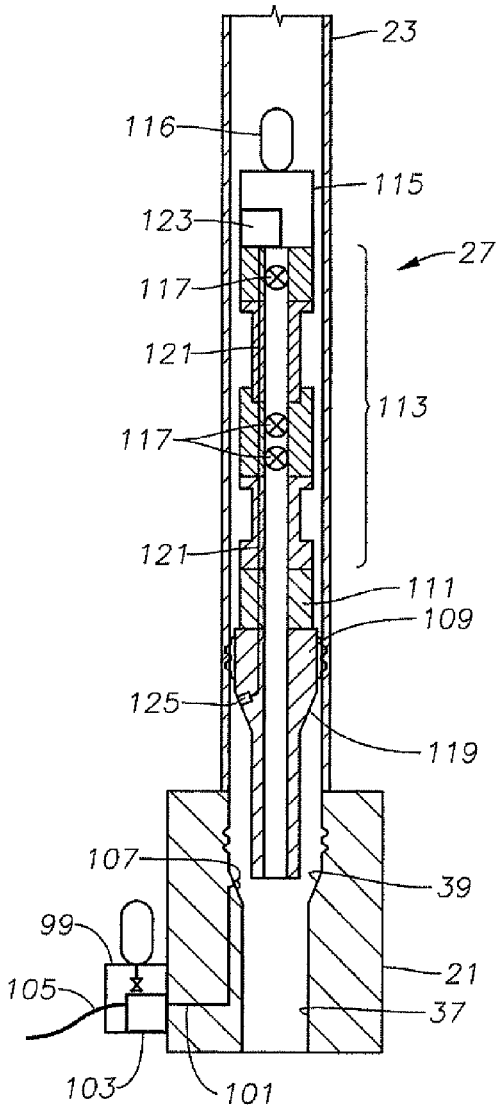
FIG. 5 is a schematic representation of a portion of the STTCS of FIG. 1, prior to landing at a horizontal subsea tree in accordance with an alternative embodiment.

Referring to FIG. 5, an alternative embodiment of STTCS 27 is shown in more detail disposed within riser 23 prior to landing in horizontal subsea tree 21. Horizontal subsea tree 21 includes the components of horizontal subsea tree 21 illustrated and described with respect to FIG. 2 and FIG. 3 above, modified as described in more detail below. In the illustrated embodiment, a subsea control module (SCM) 99 communicatively couples to horizontal subsea tree 21. SCM 99 feeds a subsea control module communication line (SCM communication line) 101 formed within horizontal subsea tree 21. In the embodiment of FIG. 5, SCM 99 includes a subsea control module battery (SCM battery) 103. SCM battery 103 supplies electric potential to SCM communication line 101. SCM battery 103 is, in turn, supplied with electric potential through an SCM electric umbilical 105 extending to a manifold, production facility, or the like. A person skilled in the art will understand that horizontal subsea tree 21, SCM 99, and SCM electric umbilical 105 may be placed on wellhead 11 with the original well completion and permanently installed with horizontal subsea tree 21.

SCM communication line 101 extends from SCM 99 through horizontal subsea tree 21 to bore 37 formed in horizontal subsea tree 21. SCM communication line 101 terminates on conical landing shoulder 39 in an electrical wet connector 107. In the illustrated embodiment, electrical wet connector 107 comprises a male connector; a person skilled in the art will understand that electrical wet connector 107 may also comprise a female connector.

As shown in FIG. 5, an alternative embodiment of STTCS 27 includes a tubing hanger (TH) 109, a tubing hanger running tool (THRT) 111, a subsea test tree (STT) 113, and a riser control module (RCM) 115. TH 109, THRT 111, STT 113, and RCM 115 generally include the components of and operate in a manner similar to TH 45, THRT 47, STT 49, and RCM 51, respectively, described above with respect to FIG. 2 and FIG. 3, modified as described below. STT 113 may include one or more valves 117 adapted to operate function within STTCS 27. RCM 115 couples to STT 113 above STT 113 and controls operation of THRT 111 and STT 113. RCM 115 may include an RCM accumulator 116 in fluid communication with operational functions of STT 113, THRT 111, and TH 109.

In the illustrated embodiment, TH 109 includes a downwardly facing conical surface 119, similar to conical surface 55 of TH 45 of FIG. 2. As shown in FIG. 5, a tubing hanger electrical wet connector 125 is positioned on conical surface 119 and communicatively couples with an STTCS communication line 121. As shown, tubing hanger electrical wet connector 125 is a female connector; a person skilled in the art will understand that tubing hanger electrical wet connector 125 may be a male connector. STTCS communication line 121 extends through the tubular wall of STTCS 27 from conical surface 119 through TH 109, THRT 111, STT 113, and RCM 115. In the illustrated embodiment, STTCS communication line 121 communicatively couples to an RCM battery 123 mounted to RCM 115. RCM battery 123 comprises a storage vessel for electrical potential. RCM 115 will receive electric potential through STTCS communication line 121 to provide electrical power to actuate hydraulic control devices. In addition, RCM 115 may also receive control signals through STTCS communication line 121. In this manner, no workover or hydraulic umbilical is need to supply hydraulic pressure to STTCS 27.

Figure 6:
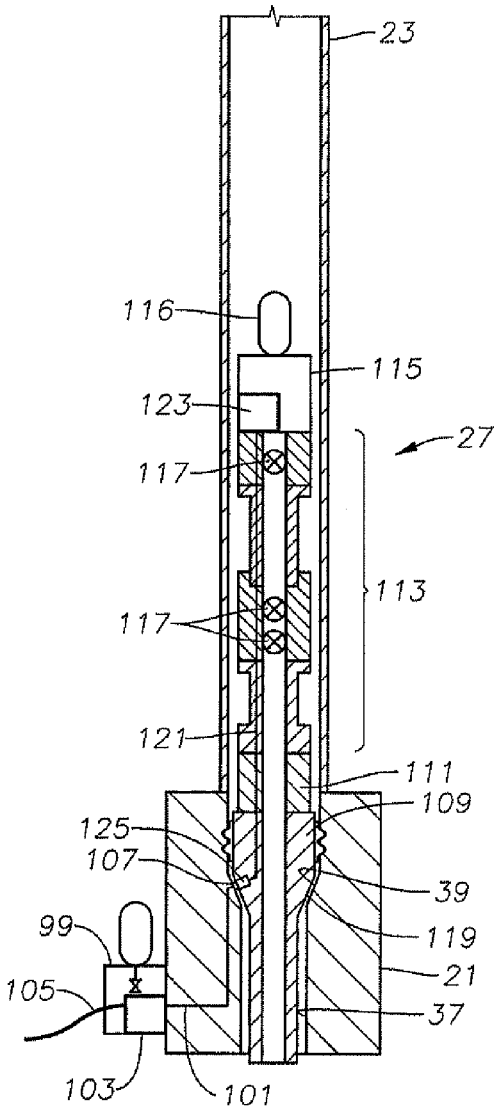
FIG. 6 is a schematic representation of the portion of the STTCS of FIG. 5, following landing at the horizontal subsea tree.

Referring now to FIG. 6, STTCS 27 will be lowered through riser 23 until conical shoulder 119 of TH 109 lands on conical shoulder 39 of horizontal subsea tree 21. As shown, tubing hanger electrical wet connector 125 will be aligned with electrical wet connector 107. When conical shoulder 119 lands on conical shoulder 39, electrical wet connector 107 will insert into tubing hanger electrical wet connector 125, and tubing hanger electrical wet connector 125 will seal to electrical wet connector 107. In this manner, electrical wet connector 107 and tubing hanger electrical wet connector 125 provide an electrical communication connection between SCM communication line 101, and STTCS communication line 121. SCM 99 may then supply a trickle charge through the electrical connection, maintaining a full charge to RCM battery 123.

In the illustrated embodiment, control communication between RCM 115 and operators located on platform 25 may occur through STTCS communication line 121, SCM communication line 101, and electrical umbilical 105. Operators may send control signals to RCM 115 and, in turn, RCM 115 will receive the signals and operate appropriate valves to provide hydraulic pressure from RCM accumulator 116 to the appropriate device, STT 113, THRT 111, or TH 109, to perform a function in response to the control signals. The valves within RCM 115 allow hydraulic pressure within RCM accumulators 116 to flow to the corresponding operations within STTCS 27. In the illustrated embodiment, these valves are electrically actuated through electric potential provided by RCM battery 123.

Figure 7:
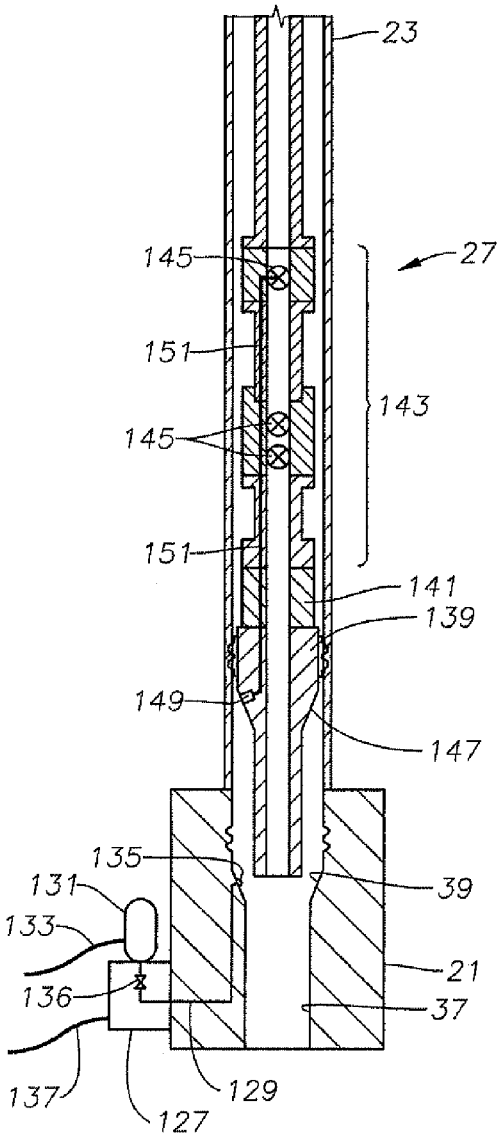
FIG. 7 is a schematic representation of a portion of the STTCS of FIG. 1, prior to landing at a horizontal subsea tree in accordance with an alternative embodiment.

Referring now to FIG. 7, another alternate embodiment of STTCS 27 is shown in more detail disposed within riser 23 prior to landing in horizontal subsea tree 21. Horizontal subsea tree 21 includes the components of horizontal subsea tree 21 illustrated and described with respect to FIG. 2 and FIG. 3 above, modified as described in more detail below. In the illustrated embodiment, a subsea control module (SCM) 127 communicatively couples to horizontal subsea tree 21. SCM 127 feeds a subsea control module communication line (SCM communication line) 129 formed within horizontal subsea tree 21. In the embodiment of FIG. 7, SCM 127 includes a subsea control module accumulator (SCM accumulator) 131. SCM accumulator 131 supplies hydraulic pressure to SCM communication line 129. SCM accumulator 131 is, in turn, supplied with hydraulic pressure from a SCM hydraulic umbilical 133 extending to a manifold, production facility, or the like. A person skilled in the art will understand that horizontal subsea tree 21, SCM 127, and SCM hydraulic umbilical 133 may be placed on wellhead 11 with the original well completion.

SCM communication line 129 extends from SCM 127 through horizontal subsea tree 21 to bore 37 formed in horizontal subsea tree 21. SCM communication line 129 terminates on conical landing shoulder 39 in a spherical face 135. Spherical face 135 is similar to and includes the components of spherical face 41 described above with respect to FIGS. 2, 3, 4A and 4B. An actuable valve 136 will be positioned on SCM communication line 129 to control hydraulic pressure flowing through SCM communication line 129. In the illustrated embodiment, valve 136 may be controlled from the surface through electrical signals received in an electric umbilical 137 communicatively coupled to SCM 127. The embodiment of FIG. 7 receives both electrical and hydraulic pressure through horizontal subsea tree 21 through SCM electrical umbilical 137 and SCM hydraulic umbilical 133, and therefore needs no battery or hydraulic accumulator to be coupled to STTCS 27.

As shown in FIG. 7, STTCS 27 includes a tubing hanger (TH) 139, a tubing hanger running tool (THRT) 141, and a subsea test tree (STT) 143. TH 139 comprises a tubing hanger adapted to support production tubing 19 (not shown in FIG. 7) suspended within horizontal subsea tree 21 and subsea wellhead 11. THRT 141 couples to TH 139 above TH 139 and is adapted to set TH 139 in horizontal subsea tree 21. STT 143 couples to THRT 141 above THRT 141 and is adapted to perform operational tasks associated with intervention, workover, and recompletion activities. A person skilled in the art will understand that STT 143 may be any suitable landing string function. SIT 143 may include one or more valves 145 adapted to operate functions within STTCS 27.

In the illustrated embodiment, TH 139 includes a downwardly facing conical surface 147. TH 139 has a first diameter extending upward from conical surface 147, and a second diameter extending downward from conical surface 147. As shown, conical surface 147 has a slope from the first diameter to the second diameter that is approximately equivalent with the slope of conical surface 39. A spheri-seal 149, similar to spheri-seal 57 of FIG. 4A and FIG. 4B, is positioned on conical surface 147 and communicatively couples with an STTCS communication line 151. STTCS communication line 151 extends in the tubular wall of STTCS 27 from conical surface 147 through TH 139, THRT 141, and STT 143. In the illustrated embodiment, STTCS communication line 151 comprises multiple communication lines each communicatively coupled to a separate valve 145 within SIT 143 or operable function within THRT 141 and TH 139. In an embodiment, a separate spheri-seal 149 and STTCS communication line 151 extends from conical surface 147 to each specific functional component of STTCS 27.

Figure 8:
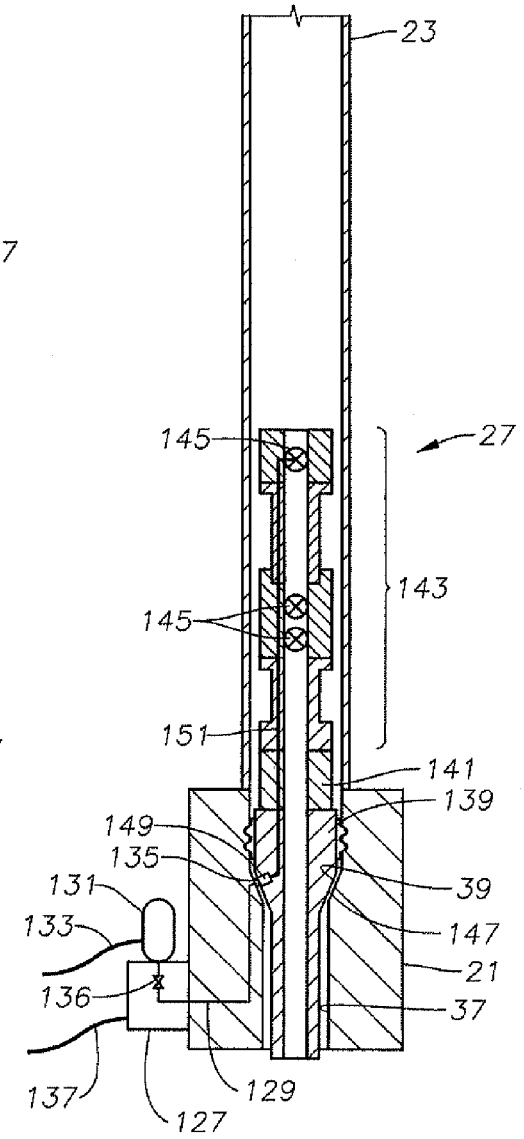
FIG. 8 is a schematic representation of the portion of the STTCS of FIG. 7, following landing at the horizontal subsea tree.

Referring now to FIG. 8, STTCS 27 will be lowered through riser 23 until conical shoulder 147 of TH 139 lands on conical shoulder 39 of horizontal subsea tree 21. As shown, each spheri-seal 149 will be aligned with a respective spherical face 135. When conical shoulder 147 lands on conical shoulder 39, spherical face 135 will insert into spheri-seal 149, and spheri-seal 149 will seal to spherical face 135. In this manner, spherical face 135 and spheri-seal 149 provide a communication connection between SCM communication line 129, and STTCS communication line 151. Valve 136 may then be opened in response to a signal from the surface so that SCM 127 may supply hydraulic pressure to SCM communication line 129.

During intervention or workover activities, SCM 127 will receive control signals from operators located at the surface through electrical umbilical 137. SM 127 will operate valves located within horizontal subsea tree 21 to allow flow from SCM communication line 129 into an STTCS communication line 151 through the associated spherical face 135 and spheri-seal 149. This hydraulic pressure will operate the function selected by the operator. SCM communication line 129 may supply each STTCS communication lines 151 through a respective spheri-seal 149. In this manner, STTCS 27 may be controlled and operated entirely through SCM 127 without need for a separate riser control module and associated accumulators.

Figure 9:
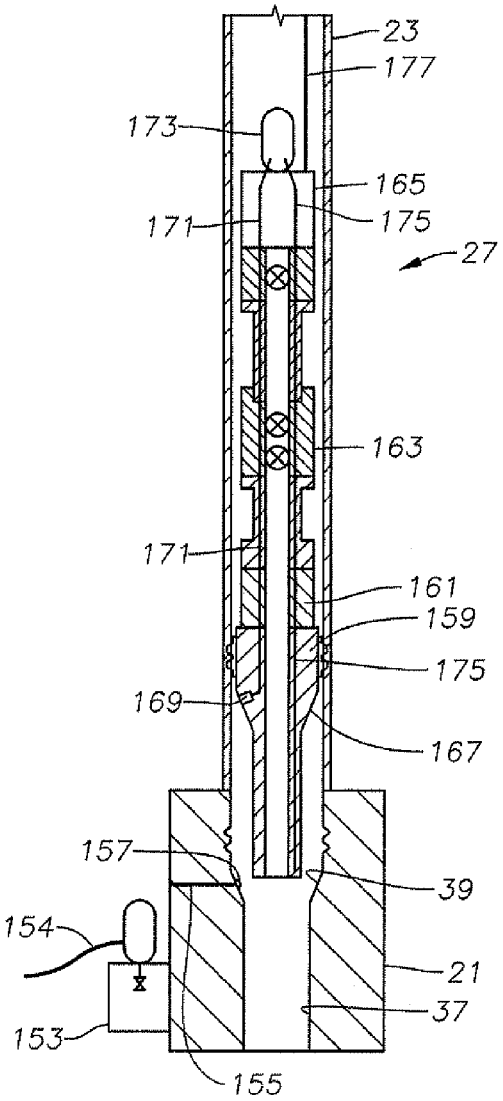
FIG. 9 is a schematic representation of a portion of the STTCS of FIG. 1, prior to landing at a horizontal subsea tree in accordance with an alternative embodiment.

Referring to FIG. 9, an alternate embodiment of STTCS 27 is shown in more detail disposed within riser 23 prior to landing in horizontal subsea tree 21. In the illustrated embodiment, a subsea control module (SCM) 153 communicatively couples to horizontal subsea tree 21. A horizontal subsea tree communication line (HT communication line) 155 is formed within horizontal subsea tree 21 and includes a port located on an exterior of horizontal subsea tree 21. A person skilled in the art will understand that horizontal subsea tree 21, and SCM 153 may be placed on wellhead 11 with the original well completion. A subsea control module umbilical 154 may communicatively couple to SCM 153 to supply SCM 153 with hydraulic pressure.

HT communication line 155 extends from an exterior of horizontal subsea tree 21 to conical landing shoulder of bore 37 formed in horizontal subsea tree 21. SCM communication line 31 terminates on conical landing shoulder 39 in a spherical face 157. As shown in FIG. 9, STTCS 27 includes a tubing hanger (TH) 159, a tubing hanger running tool (THRT) 161, a subsea test tree (STT) 163, and a riser control module (RCM) 165 similar to TH 45, THRT 47, STT 49, and RCM 51, respectively, illustrated and described with respect to FIGS. 2 and 3, and modified as described below.

In the illustrated embodiment, TH 159 includes a downwardly facing conical surface 167. TH 159 has a first diameter extending upward from conical surface 167, and a second diameter extending downward from conical surface 167. As shown, conical surface 167 has a slope from the first diameter to the second diameter that is approximately equivalent with the slope of conical surface 39. A spheri-seal 169 is positioned on conical surface 167 and communicatively couples with an STTCS communication line 171. Spheri-seal 169 and spherical face 157 are similar to and include the components of spheri-seal 57 and spherical face 41 as described above with respect to FIGS. 2, 3, 4A, and 4B. STTCS communication line 171 extends in the tubular wall of STTCS 27 from conical surface 167 through TH 159, THRT 161, STT 49, and RCM 165. In the illustrated embodiment, STTCS communication line 171 communicatively couples to an RCM accumulator 173 mounted to RCM 165. RCM accumulator 173 comprises a storage vessel for hydraulic pressure. An operational communication line 175 extends in a tubular wall of STTCS 27 from RCM 165 to STT 163, THRT 161, and TH 159. Operational communication line 175 is supplied with hydraulic pressure from RCM accumulator 173. Operational communication line 175 communicatively couples with operational functions of STT 163, THRT 161, and TH 159 to supply hydraulic pressure to STT 163, THRT 161, and TH 159 in response to control inputs from RCM 165. In the illustrated embodiment, an electrical umbilical 177 extends from RCM 165 to surface platform 25. Electrical umbilical 177 provides control communication between RCM 165 and operators located on platform 25. Operators may send control signals to RCM 165 through electrical umbilical 177 and, in turn, RCM 165 will receive the signals and operate appropriate valves to provide hydraulic pressure to the appropriate device, STT 163, THRT 161, or TH 159, to perform a function in response to the control signals. Electrical umbilical 177 is lowered with STTCS 27 and removed following completion of workover activities.

Figure 10:
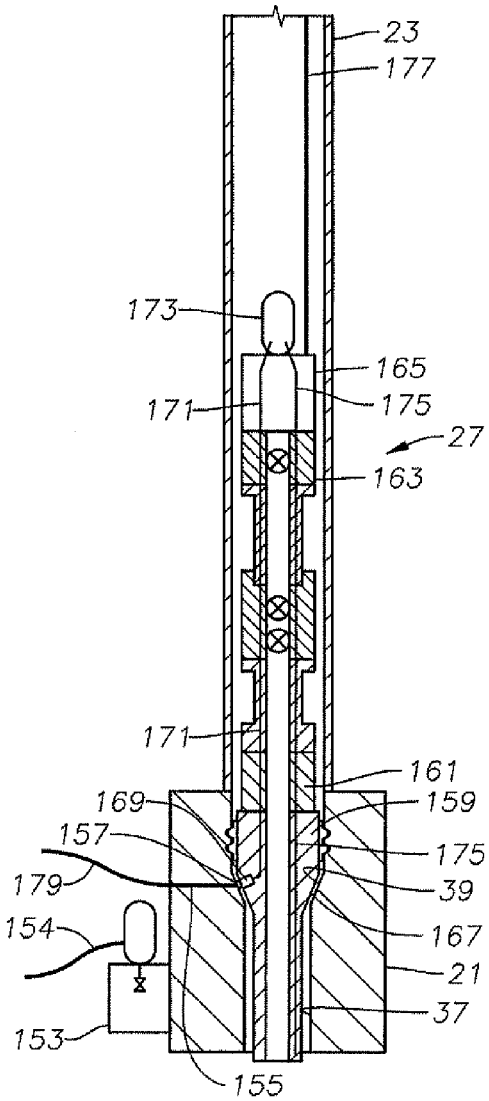
FIG. 10 is a schematic representation of the portion of the STTCS of FIG. 9, following landing at the horizontal subsea tree.

Referring now to FIG. 10, STTCS 27 will be lowered through riser 23 until conical shoulder 167 of TH 159 lands on conical shoulder 39 of horizontal subsea tree 21. As shown, spheri-seal 169 will be aligned with spherical face 157. When conical shoulder 167 lands on conical shoulder 39, spherical face 157 will insert into spheri-seal 169, and spheri-seal 169 will seal to spherical face 157. In this manner, spherical face 41 and spheri-seal 169 provide a communication connection between HT communication line 155, and STTCS communication line 171. An installation workover control system (IWOCS) hydraulic umbilical 179 may be run from the surface external to riser 23 to the external port of HT communication line 155. IWOCS hydraulic umbilical 179 is an umbilical to supply hydraulic fluid pressure that is remove following completion of the workover activities. A remotely operated vehicle may then couple IWOCS hydraulic umbilical 179 to HT communication line 155, providing hydraulic pressure to HT communication line 155. Hydraulic pressure will then flow into STTCS communication line 171 through spherical face 157 and spheri-seal 169. This hydraulic pressure will trickle charge RCM accumulator 173, maintaining hydraulic pressure within STTCS 27 without the need of a hydraulic umbilical to be run from platform 25 to horizontal subsea tree 21 within riser 23.

Figure 11:
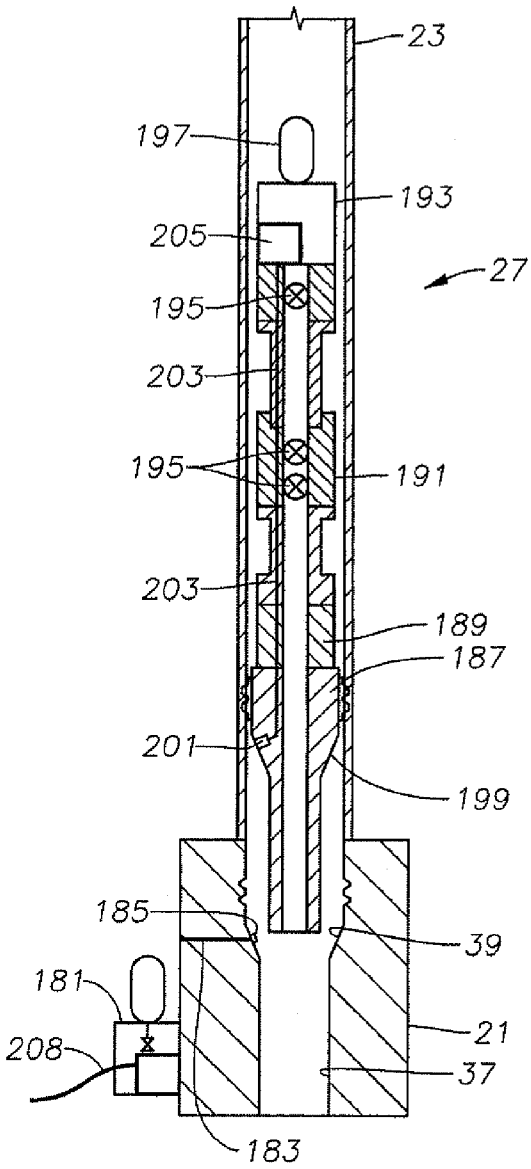
FIG. 11 is a schematic representation of a portion of the STTCS of FIG. 1, prior to landing at a horizontal subsea tree in accordance with an alternative embodiment.

Referring to FIG. 11, an alternate embodiment of STTCS 27 is shown in more detailed disposed within riser 23 prior to landing in horizontal subsea tree 21. Horizontal subsea tree 21 includes the components of horizontal subsea tree 21 illustrated and described with respect to FIG. 2 and FIG. 3 above, modified as described in more detail below. In the illustrated embodiment, a subsea control module (SCM) 181 communicatively couples to horizontal subsea tree 21. A person skilled in the art will understand that horizontal subsea tree 21, and SCM 181 may be placed on wellhead 11 with the original well completion. A horizontal subsea tree communication line (HT communication line) 183 is formed within horizontal subsea tree 21 and includes a port located on an exterior of horizontal subsea tree 21.

HT communication line 183 extends from an exterior of horizontal subsea tree 21 to conical shoulder 39 of bore 37 formed in horizontal subsea tree 21. HT communication line 183 terminates on conical landing shoulder 39 in an electrical wet connector 185. In the illustrated embodiment, electrical wet connector 185 comprises a male connector; a person skilled in the art will understand that electrical wet connector 185 may also comprise a female connector.

As shown in FIG. 11, STTCS 27 includes a tubing hanger (TH) 187, a tubing hanger running tool (THRT) 189, a subsea test tree (STT) 191, and a riser control module (RCM) 193. TH 187, THRT 189, STT 191, and RCM 193 generally include the components of and operate in a manner similar to TH 45, THRT 47, STT 49, and RCM 51 described above with respect to FIG. 2 and FIG. 3, modified as described below. STT 191 may include one or more valves 195 adapted to operate function within STTCS 27. RCM 193 couples to STT 191 above STT 191 and controls operation of THRT 189, and STT 191. RCM 193 may include an RCM accumulator 197 in fluid communication with operational functions of STT 191, THRT 189, and TH 187. In the illustrated embodiment, TH 187 includes a downwardly facing conical surface 199, similar to conical surface 55 of TH 45 of FIG. 2. As shown in FIG. 11, a tubing hanger electrical wet connector 201 is positioned on conical surface 199 and communicatively couples with an STTCS communication line 203. As shown, tubing hanger electrical wet connector 201 is a female connector; a person skilled in the art will understand that tubing hanger electrical wet connector 201 may be a male connector. STTCS communication line 203 extends through the tubular wall of STTCS 27 from conical surface 199 through TH 187, THRT 189, STT 191, and RCM 193. In the illustrated embodiment, STTCS communication line 203 communicatively couples to an RCM battery 205 mounted to RCM 193. RCM battery 205 comprises a storage vessel for electrical potential. RCM 193 may also receive control signals through STTCS communication line 203.

Figure 12:
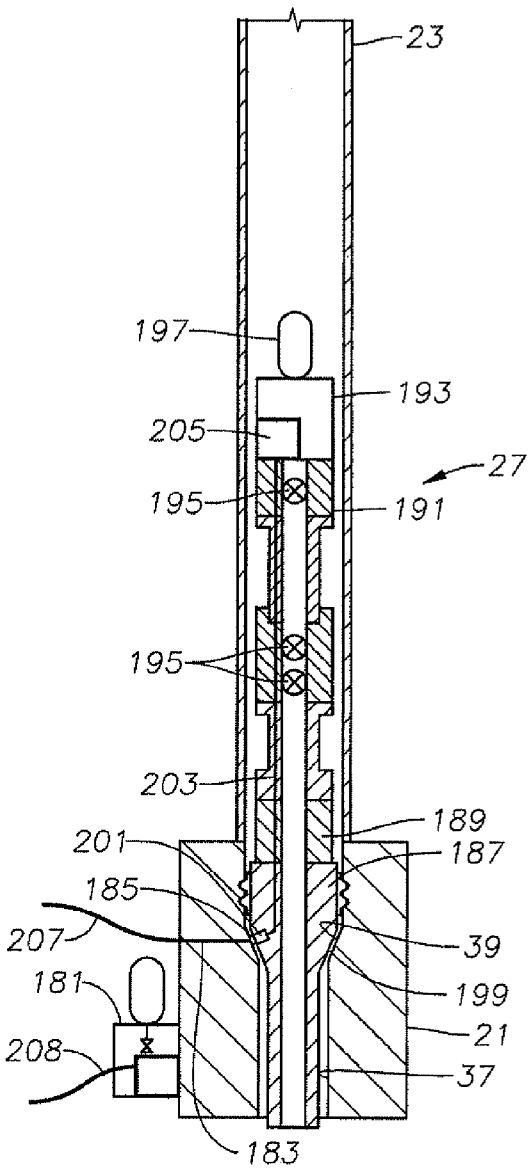
FIG. 12 is a schematic representation of the portion of the STTCS of FIG. 11, following landing at the horizontal subsea tree.

Referring now to FIG. 12, STTCS 27 will be lowered through riser 23 until conical shoulder 199 of TH 187 lands on conical shoulder 39 of horizontal subsea tree 21. As shown, tubing hanger electrical wet connector 201 will be aligned with electrical wet connector 185. When conical shoulder 199 lands on conical shoulder 39, electrical wet connector 185 will insert into tubing hanger electrical wet connector 201, and tubing hanger electrical wet connector 201 will seal to electrical wet connector 185. In this manner, electrical wet connector 185 and tubing hanger electrical wet connector 201 provide an electrical communication connection between HT communication line 183, and STTCS communication line 203. An electrical umbilical 207 may then be run from the surface and coupled to the external port of HT communication line 183 by a remotely operated vehicle to supply electrical potential and control signals to RCM battery 205 and RCM 193, respectively. An SCM electrical umbilical 208 communicatively couples to SCM 181 to provide electric potential to SCM 181. SCM electrical umbilical 208 is not needed for completion of workover activities; instead, control and operation of workover activities is conducted through electrical umbilical 207.

In the illustrated embodiment, control communication between RCM 193 and operators located on platform 25 may occur through STTCS communication line 203, HT communication line 183, and electrical umbilical 207. Operators may send control signals to RCM 193 and, in turn, RCM 193 will receive the signals and operate appropriate valves to provide hydraulic pressure from RCM accumulator 197 to the appropriate device, STT 191, THRT 189, or TH 187, to perform a function in response to the control signals.

Accordingly, the disclosed embodiments provide numerous advantages. For example, the disclosed embodiments provide an STTCS that eliminates the need for umbilicals to be run in the riser string and embodiments requiring no additional umbilicals following the initial well completion. This STTCS reduces running and retrieval time for the STTCS, allowing intervention, workover, and completion operations to be performed in a shorter time period. In addition, the shorter running and retrieval time significantly reduces the operating costs associated with workover and completion activities. Still further, the disclosed STTCS reduces the amount of equipment needed for the workover and completion further reducing the cost of use. In addition, the elimination of expensive umbilical reel assemblies further reduces the operational risk during running and retrieval operations, greatly increasing worker safety.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A method for controlling a subsea completion or workover assembly in a subsea well having a subsea tree member with a bore landing shoulder for receiving a tubing hanger, the method comprising:

(a) providing the subsea tree member with a subsea tree member communication passage leading from an exterior of the subsea tree member to an upward facing subsea tree member port in the landing shoulder;

(b) connecting a riser from the subsea tree member to a platform at a sea surface;

(c) providing the tubing hanger with a landing surface and a downward facing tubing hanger port on the landing surface, the tubing hanger having a tubing hanger communication passage leading through the tubing hanger from the tubing hanger port to an upper end of the tubing hanger;

(d) securing a string of tubing to the tubing hanger, securing the tubing hanger to a running tool assembly and linking the tubing hanger communication passage to the running tool assembly with a running tool communication line;

(e) running the tubing hanger, the tubing, and the running tool assembly through the riser to land the landing surface on the landing shoulder and registering the tubing hanger port with the subsea tree member port, thereby connecting the subsea tree member communication passage with the running tool assembly via the tubing hanger communication passage and the running tool communication line; and (f) supplying hydraulic fluid pressure and electric potential to the running tool assembly and performing operations with the running tool assembly, wherein at least one of the hydraulic fluid pressure and the electric potential is supplied via the subsea tree member communication passage, the tubing hanger communication passage and the running tool communication line.

2. The method of claim 1, wherein step (f) comprises supplying the hydraulic fluid pressure through the subsea tree member communication passage, the tubing hanger communication passage and the running tool communication line, and supplying the electric potential through an electrical umbilical extending from the surface to the running tool assembly.

3. The method of claim 1, wherein step (c) further comprises providing the subsea tree member with a subsea control module (SCM) that provides hydraulic fluid pressure to control valves of the subsea tree member, and the subsea tree member communication passage connects to the SCM.

4. The method of claim 1, wherein in step (f), the hydraulic fluid pressure is supplied to the subsea tree communication passage with a workover hydraulic umbilical exterior of the riser.

5. The method of claim 1, wherein step (f) comprises providing the electric potential through the subsea tree communication passage.

6. The method of claim 1, wherein step (c) further comprises providing the subsea tree member with a subsea control module (SCM) that electrically controls control valves of the subsea tree member, and wherein step (f) comprises providing the electric potential with the SCM to the subsea tree communication passage.

7. The method of claim 1, wherein step (c) further comprises providing the subsea tree member with a subsea control module (SCM) having a hydraulic accumulator for hydraulically operating control valves of the subsea tree member, and wherein step (f) comprises providing the hydraulic pressure through the subsea tree member communication passage with the hydraulic accumulator.

8. The method of claim 7, wherein providing the electric potential in step (f) comprises supplying the electric potential through an electrical umbilical extending from the surface through the riser to the running tool.

9. The method of claim 1, wherein in step (f), the electrical potential is supplied by supplying the electric potential to the subsea tree member communication passage with a workover electrical umbilical exterior of the riser.

10. The method of claim 9, wherein:

step (c) further comprises mounting a hydraulic accumulator to the running tool assembly;

step (e) comprises running the hydraulic accumulator through the riser; and step (f) comprises supplying the hydraulic pressure to the running tool assembly from the hydraulic accumulator.

11. A method for controlling a subsea completion or workover assembly in a subsea well having a subsea tree member with a bore landing shoulder for receiving a tubing hanger, the method comprising:

(a) providing the subsea tree member with a subsea tree member communication passage leading from an exterior of the subsea tree member to an upward facing subsea tree member port in the landing shoulder, providing the subsea tree member with a subsea control module (SCM) that provides hydraulic fluid pressure to control valves of the subsea tree member, and connecting the subsea tree member communication passage to the SCM;

(b) connecting a riser from the subsea tree member to a platform at a sea surface;

(c) providing the tubing hanger with a landing surface and a downward facing tubing hanger port in the landing surface, and providing the tubing hanger with a tubing hanger communication passage leading from the tubing hanger port to an upper end of the tubing hanger;

(d) securing a string of tubing to the tubing hanger, securing the tubing hanger to a running tool assembly, and connecting a running tool assembly communication line between the tubing hanger communication passage and the running tool assembly;

(e) running the tubing hanger, the string of tubing, and the running tool through the riser to land the landing surface on the landing shoulder and registering the subsea tree member port with the tubing hanger port, thereby connecting the subsea tree member communication passage with the running tool assembly via the tubing hanger communication passage and the running tool assembly communication line; and (f) supplying hydraulic fluid pressure and electric potential to the running tool and performing operations with the running tool assembly, wherein at least one of the hydraulic fluid pressure and the electric potential is supplied from the SCM via the subsea tree member communication passage, the tubing hanger communication passage and the running tool assembly communication line.

12. The method of claim 11, wherein step (f) comprises providing the hydraulic pressure from the SCM and supplying the electric potential to the running tool assembly through an electrical umbilical extending from the surface through the riser to the running tool assembly.

13. The method of claim 11, wherein:

step (d) comprises mounting a hydraulic pressure accumulator to the running tool assembly; and step (f) comprises providing the electric potential from the SCM, and the hydraulic fluid pressure from the accumulator.

14. The method of claim 11, wherein step (f) comprises providing the electric potential and the hydraulic fluid pressure from the SCM.

15. The method of claim 11, wherein:

step (d) comprises mounting a battery and a hydraulic pressure accumulator to the running tool assembly;

the subsea tree member port and the tubing hanger port comprise wet mate electrical connectors, in step (f), the battery supplies the electric potential and the SCM supplies control signals to the running tool assembly and an electrical trickle charge to the battery through the subsea tree member communication passage and the running tool assembly communication line; and in step (f), the accumulator supplies the hydraulic fluid pressure to the running tool assembly.

16. A subsea completion or workover assembly in a subsea well having a subsea tree member with a bore landing shoulder for receiving a tubing hanger, comprising:

a subsea tree member communication passage formed in the subsea tree member leading from an exterior of the subsea tree member to an upward facing subsea tree member port in the landing shoulder;

a riser extending from the subsea tree member to a platform at a sea surface;

the tubing hanger having a landing surface and a downward facing tubing hanger port in the landing surface, the tubing hanger having a tubing hanger communication passage leading from the tubing hanger port to an upper end of the tubing hanger;

a running tool assembly connected to the tubing hanger;

a running tool assembly communication line that connects to the tubing hanger communication passage at the upper end of the tubing hanger; wherein the tubing hanger port registers with the subsea tree member port when the tubing hanger lands on the landing shoulder, thereby connecting the subsea tree member communication passage with the running tool assembly communication line via the tubing hanger communication passage;

the running tool assembly operates in response to hydraulic fluid pressure and electric potential supplied to the running tool assembly; and at least one of the hydraulic fluid pressure and the electrical potential pass through the subsea tree member communication passage, the tubing hanger communication passage, and the running tool assembly communication line.

17. The assembly of claim 16, wherein the hydraulic fluid pressure passes through the subsea tree member communication passage and the electric potential passes through an electrical umbilical extending from the surface through the riser to the running tool assembly.

18. The assembly of claim 16, further comprising a subsea control module (SCM) mounted to the subsea tree member, the SCM and providing the hydraulic fluid pressure to the running tool assembly through the subsea tree member communication passage.

19. The assembly of claim 16, further comprising a workover hydraulic umbilical exterior of the riser that supplies the hydraulic fluid pressure to the running tool assembly via the subsea tree member communication passage.

20. The assembly of claim 16, wherein the electric potential passes through the subsea tree member communication passage.

21. The assembly of claim 16, further comprising a subsea control module (SCM) mounted to the horizontal subsea tree member that provides the electric potential through the subsea tree member communication passage to the running tool assembly.

22. The assembly of claim 21, further comprising a hydraulic accumulator mounted to the running tool assembly that supplies the running tool assembly with the hydraulic pressure.

23. The assembly of claim 16, further comprising:

a battery mounted to the running tool assembly that supplies the electric potential to the running tool assembly.

24. The assembly of claim 16, further comprising a workover electrical umbilical exterior of the riser and connected to the subsea tree member communication passage to supply the electric potential to the running tool assembly.

25. The assembly of claim 16, further comprising:

a subsea control module (SCM) mounted to the subsea tree member; and a hydraulic accumulator operatively connected with the SCM on an exterior of the riser, the accumulator supplying the running tool assembly with the hydraulic pressure.

* * * * *